US006710486B1

(12) United States Patent
Horng et al.

(10) Patent No.: US 6,710,486 B1
(45) Date of Patent: Mar. 23, 2004

(54) HOUSING STRUCTURE FOR A HEAT-DISSIPATION FAN

(75) Inventors: Alex Horng, Kaohsiung (TW); Ching-Sheng Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 10/340,787

(22) Filed: Jan. 13, 2003

(51) Int. Cl.[7] ..... H02K 5/00
(52) U.S. Cl. ..... 310/89; 310/59; 310/51
(58) Field of Search ..... 310/89, 51, 58, 310/59, 62, 63, 60 A

(56) References Cited

U.S. PATENT DOCUMENTS 5,743,721 A * 4/1998 Graham et al. ..... 415/58.4
5,751,079 A * 5/1998 Bagherpour et al. ..... 310/59
5,763,969 A * 6/1998 Metheny et al. ..... 310/62
5,936,320 A * 8/1999 Takeda et al. ..... 310/89
5,955,803 A * 9/1999 Gandhi et al. ..... 310/52
6,040,645 A * 3/2000 Lynch ..... 310/58

* cited by examiner

*Primary Examiner*—Thahnh Lam
(74) *Attorney, Agent, or Firm*—Bacon & Thomas, PLLC

(57) ABSTRACT

A housing structure for the heat-dissipation fan comprises a housing, a plurality of axial guide blades and a plurality of radial air inlets. The housing is provided with an air inlet and an air outlet between which receiving a stator and a rotor. The axial guide blades are equi-spaced and radially extended outward from the housing proximate the air inlet. Each of the radial air inlets is formed between any two axial guide blades. When the rotor is rotated, airflow sucked through the radial air inlets is guided parallel to an axis of the housing running from the air inlet to the air outlet so as to increase air inlet amount and reduce air noise.

10 Claims, 9 Drawing Sheets

HOUSING STRUCTURE FOR A HEAT-DISSIPATION FAN

BACKGROUND OF THE INVENTION

1. Field of the Invention

The present invention is related to a housing structure for a heat-dissipation fan and more particularly to the housing structure having a plurality of axial guide blades to form radial air inlets therebetween that air inflow is increased and air noise is reduced.

2. Description of the Related Art

Referring to FIG. 1, a conventional axial-flow type fan mainly includes a housing 10, a stator 20 and a rotor 30. The housing 10 is provided with an air inlet 11, an air outlet 12, a bearing seat 13 and a plurality of ribs 14. The stator 20 is fittingly connected to the bearing seat 13. The rotor 30 includes a hub 31 and blades 32 surrounding therearound; a shaft 33 is rotatably received in the stator 20 so that an alternative magnetic field generated by the stator 20 is able to rotate the rotor 30. When the blades 32 are rotated, air may be sucked into the housing 10 from the air inlet 11 and blown out of the housing 10 from the air outlet 12. The fan, has been widely used, is simplified for structure and manufacture, but it allows air inflow only sucked into the air inlet 11 that air inlet amount is limited by the measurements of the air inlet 11. Moreover, it is apparent that the rotations of the distal ends of the blades 32 may cause air turbulence and wind shear on the inner wall of the housing 10; airflow between the upstream and the downstream of the blades 32 may be unbalanced. Due to these drawbacks, the static pressure-flow rate characteristic (P-Q characteristic) of the fan is undesired.

Another conventional fan of U.S. Pat. No. 6,132,171, issued on Oct. 17, 2000, titled "a blower and method for molding housing thereof" discloses a fan housing with air inlet. A plurality of annular plates, proximate the air inlet, are equi-spaced and stacked to form radial annular gaps therebetween. When the blower is rotated, ambient air may be sucked into the housing through the annular gaps so that air inlet amount is increased. However, an additional airflow through the annular gaps is perpendicular to airflow through the air inlet that the convergence of the airflow may cause air turbulence and air noise. The P-Q characteristic of the blower is still undesired although it is provided with an additional air inlet amount. There is a need for the conventional housing to improve the P-Q characteristic.

The present invention intends to provide a housing structure for a heat-dissipation fan having axial guide blades which are equi-spaced to form radial air inlets therebetween. Airflow through the radial air inlets is guided parallel to an axis of the housing in such a way to mitigate and overcome the above problem.

SUMMARY OF THE INVENTION

The primary objective of this invention is to provide a housing structure for a heat-dissipation fan having axial guide blades, proximate an air inlet, adapted to form radial air inlets through which to guide airflow along an axis so as to increase air inlet amount and reduce air noise.

The secondary objective of this invention is to provide a housing structure for a heat-dissipation fan having inclined guide blades adapted to form radial air inlets and to face a rotational direction of the fan so as to increase air inlet amount and reduce air noise.

The another objective of this invention is to provide a housing structure for a heat-dissipation fan having an expanded air outlet shaped as a bell so as to increase measurements.

The another objective of this invention is to provide a housing structure for a heat-dissipation fan having axial guide blades made of metal so as to increase heat-dissipation efficiency.

The housing structure for the heat-dissipation fan in accordance with the present invention mainly comprises a housing, a plurality of axial guide blades and a plurality of radial air inlets. The housing is provided with an air inlet and an air outlet between which receiving a stator and a rotor. The axial guide blades are equi-spaced and radially extended outward from the housing proximate the air inlet. Each of the radial air inlets is formed between any two axial guide blades. When the rotor is rotated, airflow sucked through the radial air inlets is guided parallel to an axis of the housing running from the air inlet to the air outlet so as to increase air inlet amount and reduce air noise.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
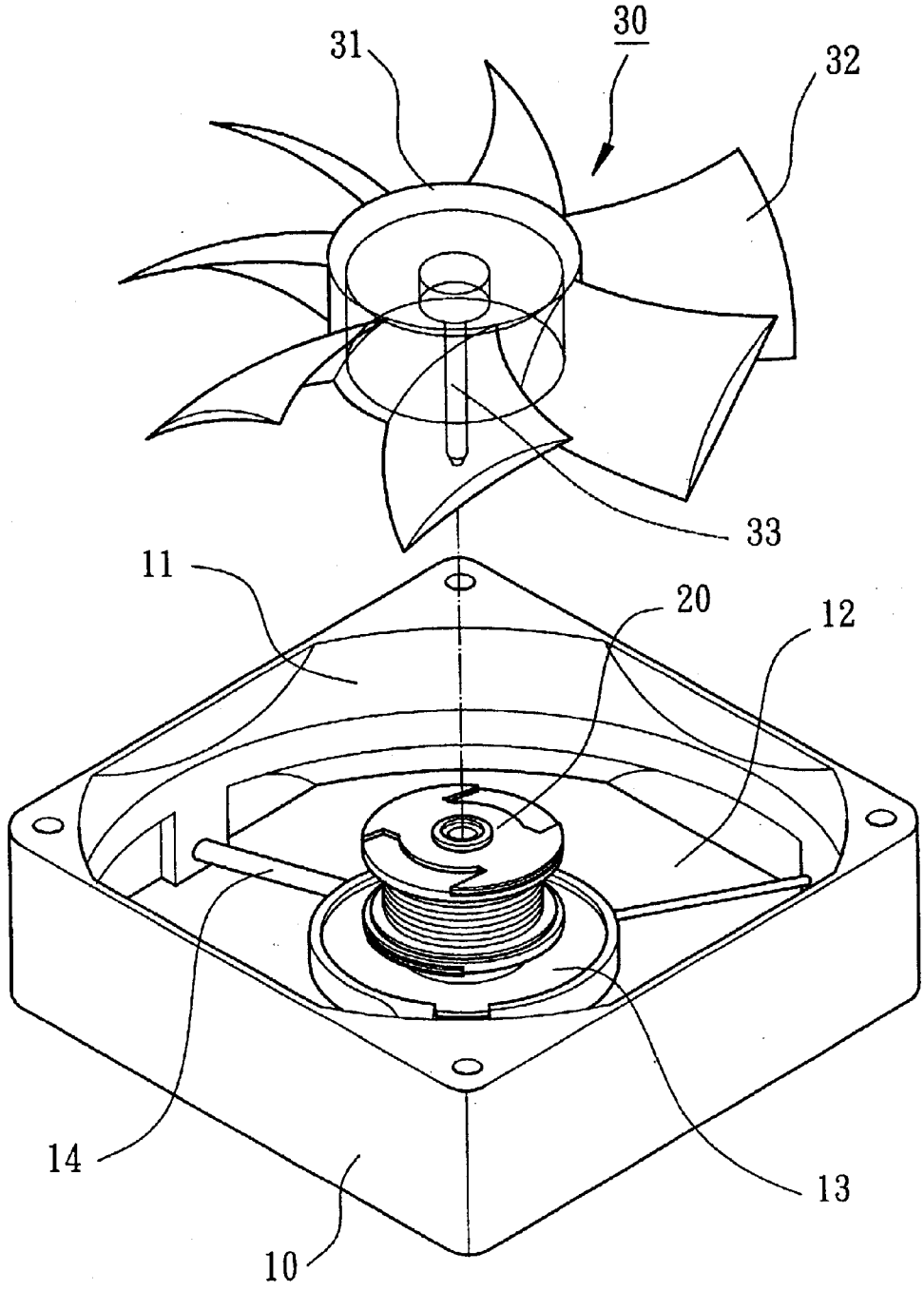
FIG. 1 PRIOR ART
FIG. 1 is an exploded perspective view of a conventional fan in accordance with the prior art.

Referring now to the drawings, there are four embodiments of the present invention shown therein, which include generally a primary housing member and a secondary fan member.

Figure 2:
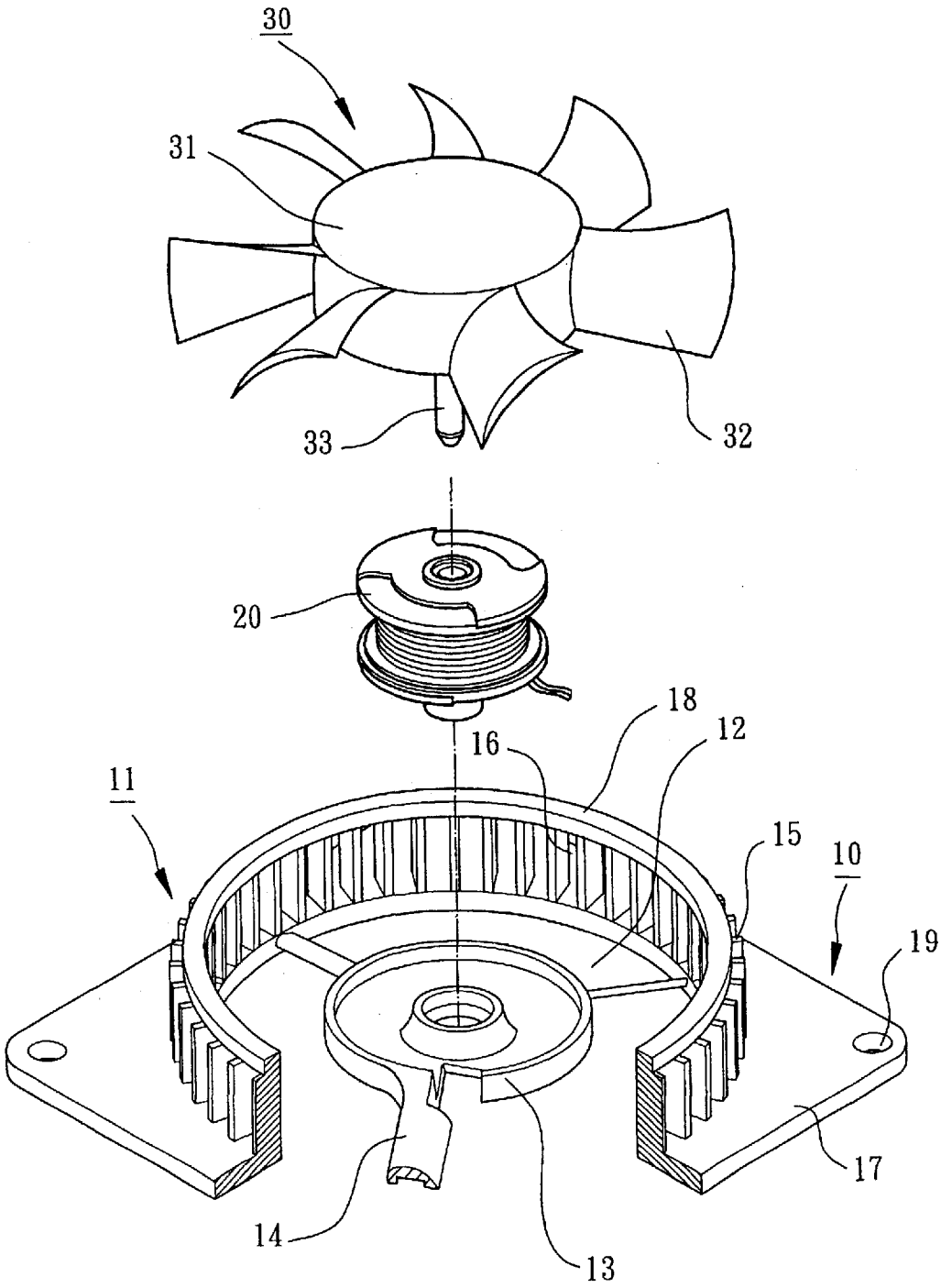
FIG. 2 is an exploded perspective view of a housing structure for a heat-dissipation fan in accordance with a first embodiment of the present invention.

Referring to FIG. 2, reference numerals of the embodiments have applied the identical numerals of the conventional fan. The housing and the fan of the embodiments have the similar configuration and same function as the conventional fan and the detailed descriptions are omitted.

Figure 3:
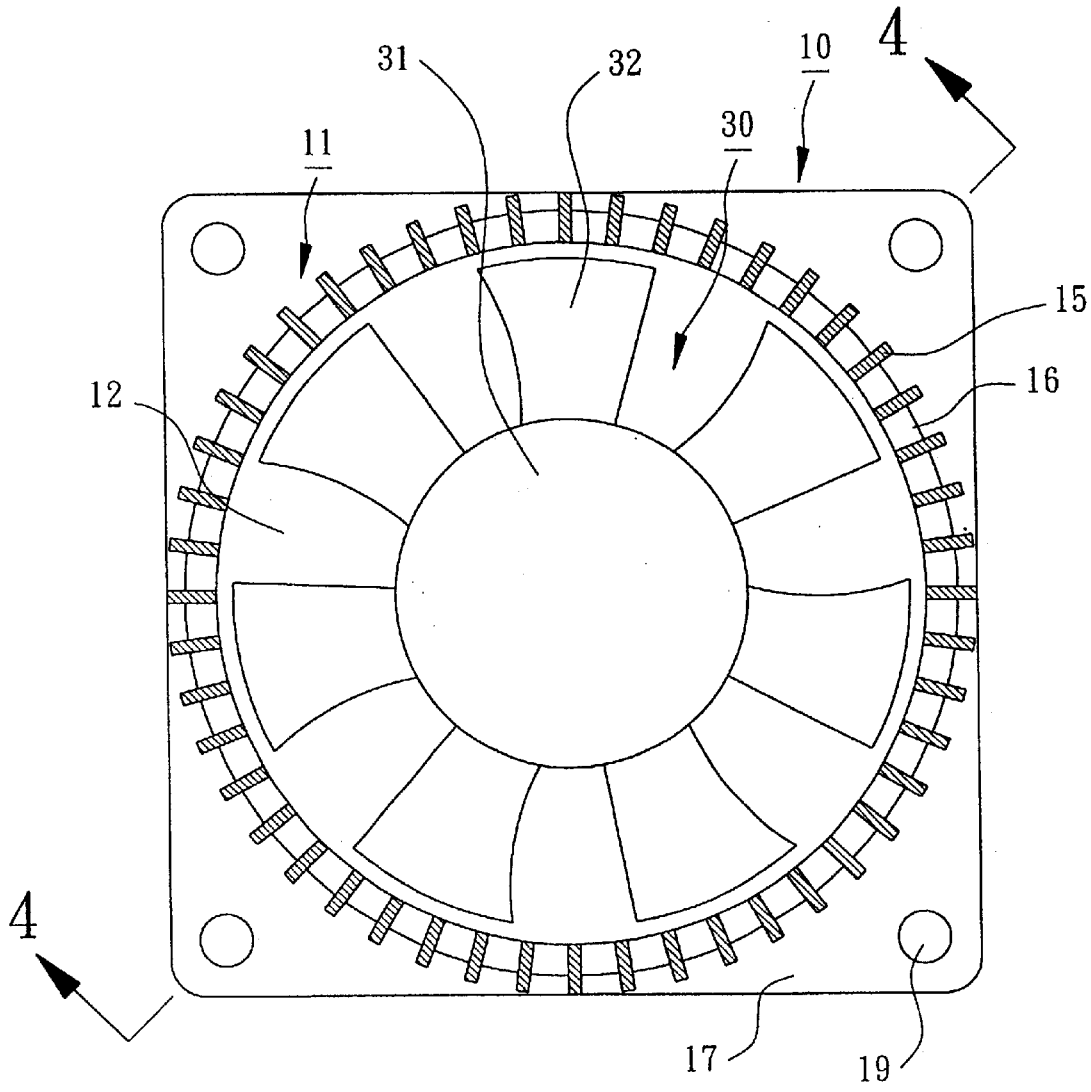
FIG. 3 is a top view of the housing structure for the heat-dissipation fan in accordance with the first embodiment of the present invention.

Referring to FIGS. 2 and 3, a housing structure for a heat-dissipation fan in accordance with the first embodiment of the present invention includes a housing 10, a plurality of axial guide blades 15 and a plurality of radial air inlets 16. The housing 10 is provided with an air inlet 11 and an air outlet 12 between which receiving a stator 20 and a rotor 30. The axial guide blades 15 are equi-spaced and radially extended outward from the housing 10 proximate the air inlet 11. Each of the radial air inlets 16 is formed between any two axial guide blades 15. When the rotor 30 is rotated, airflow sucked through the radial air inlets 16 is guided parallel to an axis of the housing 10 running from the air inlet 11 to the air outlet 12 so as to increase air inlet amount and reduce air noise.

Referring again to FIGS. 2 and 3, the housing 10 includes a space defined between the air inlet 11 and the air outlet 12 adapted to contain the stator 20 and the rotor 30. The housing 10 further includes a base plate 17 arranged therearound proximate the air outlet 12. The axial guide blades 15 are formed as regular flat pieces and extended outward from the housing 10 to define an annular wall with respect to the base plate 17. Meanwhile, the radial air inlets 16 are regularly formed on the annular wall of the housing 10. When the rotor 30 is rotated, the blades 32 suck airflow through the radial air inlets 16 in addition to the air inlet 11. Therefore, total air inlet amount is increased, as best shown in FIG. 4.

Figure 4:
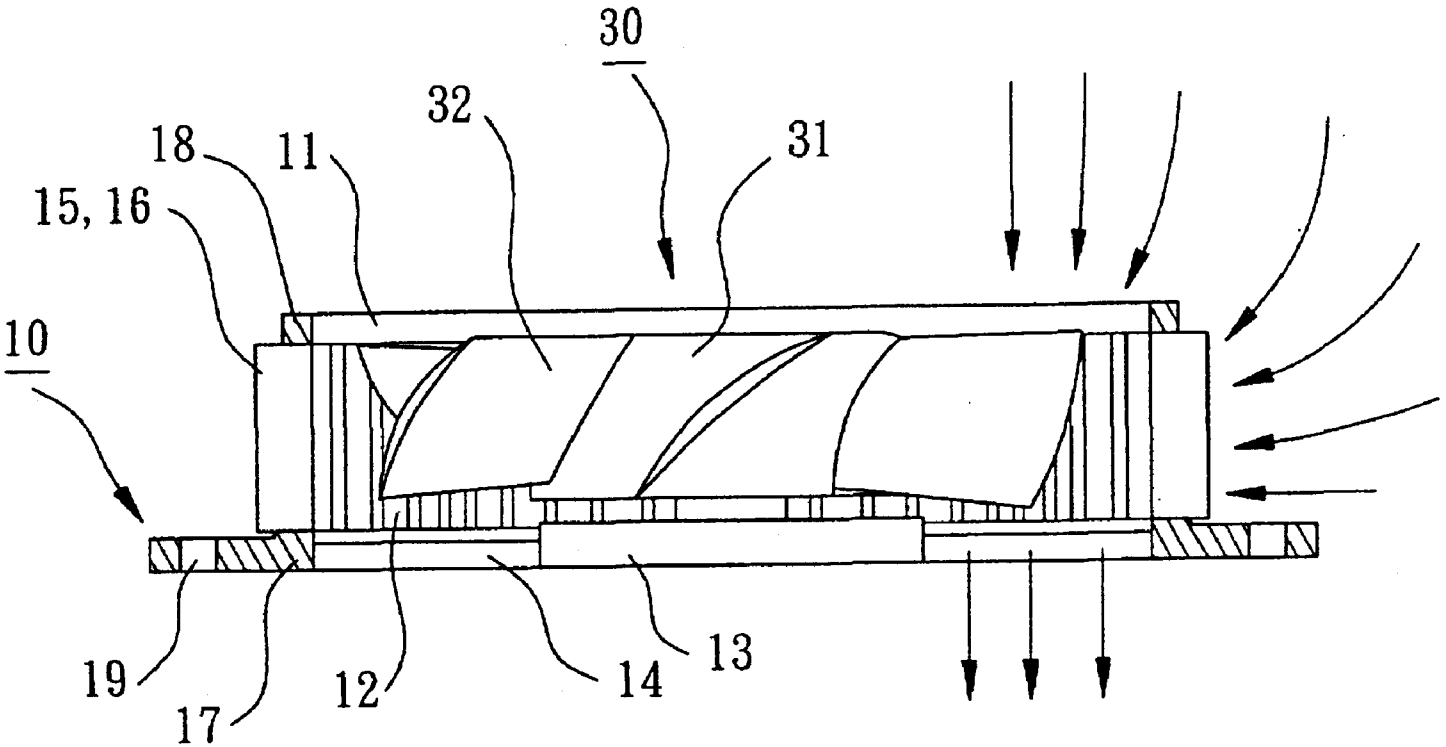
FIG. 4 is a cross-sectional view, taken along line 4—4 in FIG. 3, of the housing structure for the heat-dissipation fan in accordance with the first embodiment of the present invention.

Referring to FIG. 4, when the rotor 30 is rotated, major airflow is sucked through the air inlet 11 into the housing 10. Also, the blades 32 change airflow, sucked though the radial air inlets 16 on the base plate 17, from radial direction to the axis direction of the housing 10. Due to the additional airflow, airflow between the upstream and the downstream of the blades 32 can be balanced. Consequently, the P-Q characteristic of the rotor 30 is improved and air noise is reduced.

In order to intensify the entire structure, the housing 10 further includes an annular support 18 integrally connected to top portions of the axial guide blades 15. Alternatively, the axial guide blades 15 and the annular support 18 are formed as sectional elements and assembled on the base plate 17. The axial guide blades 15 and the radial air inlets 16 are punched if the housing 10 is made of metal or alloy. Meanwhile, the axial guide blades 15 may be formed as heat-dissipation fins to increase heat-dissipation efficiency while the airflow passing through between the axial guide blades 15. Moreover, the housing 10 includes a plurality of assembling holes 19 for conveniently assembling.

Figure 5:
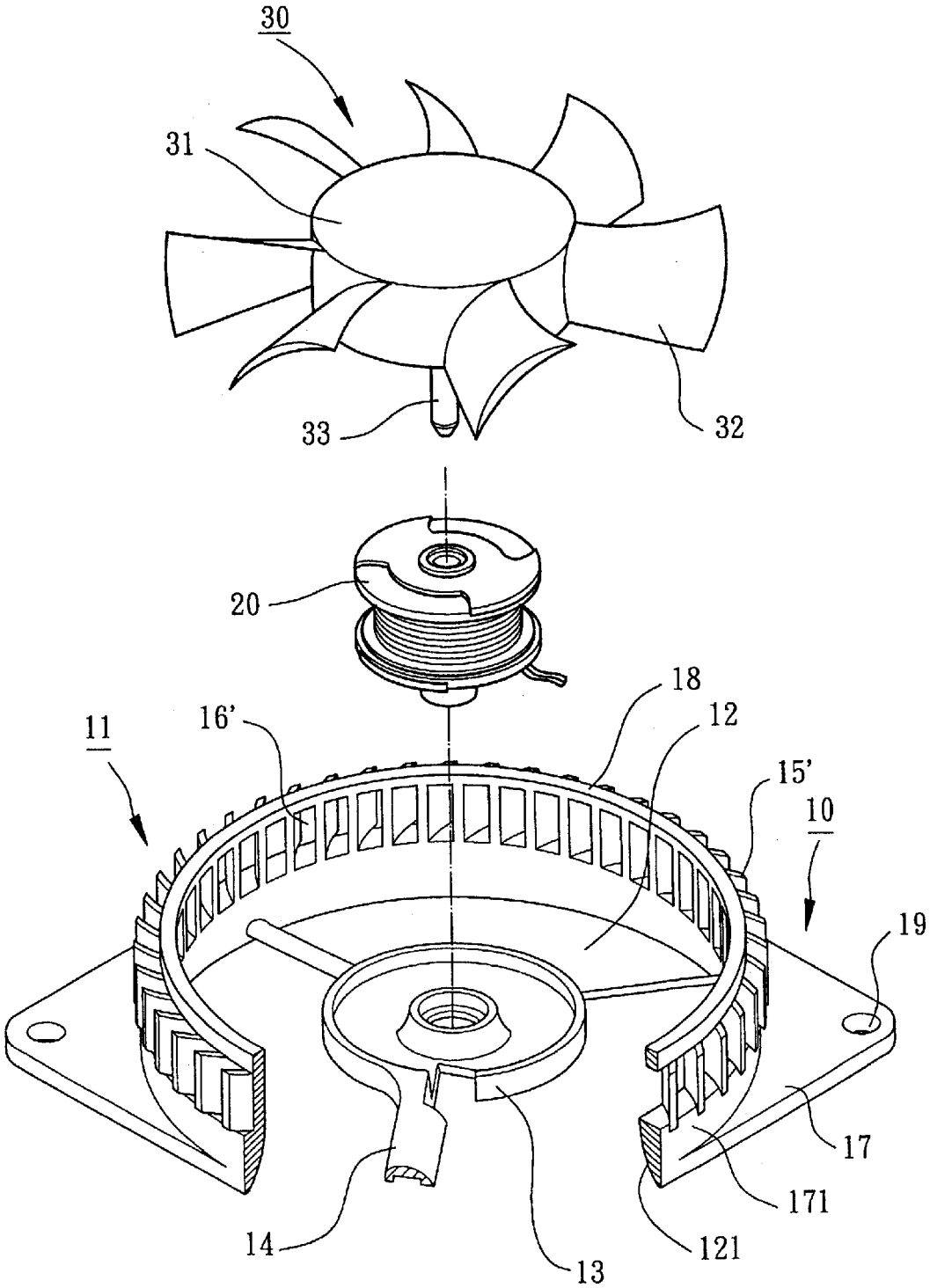
FIG. 5 is an exploded perspective view of a housing structure for a heat-dissipation fan in accordance with a second embodiment of the present invention.
Figure 6:
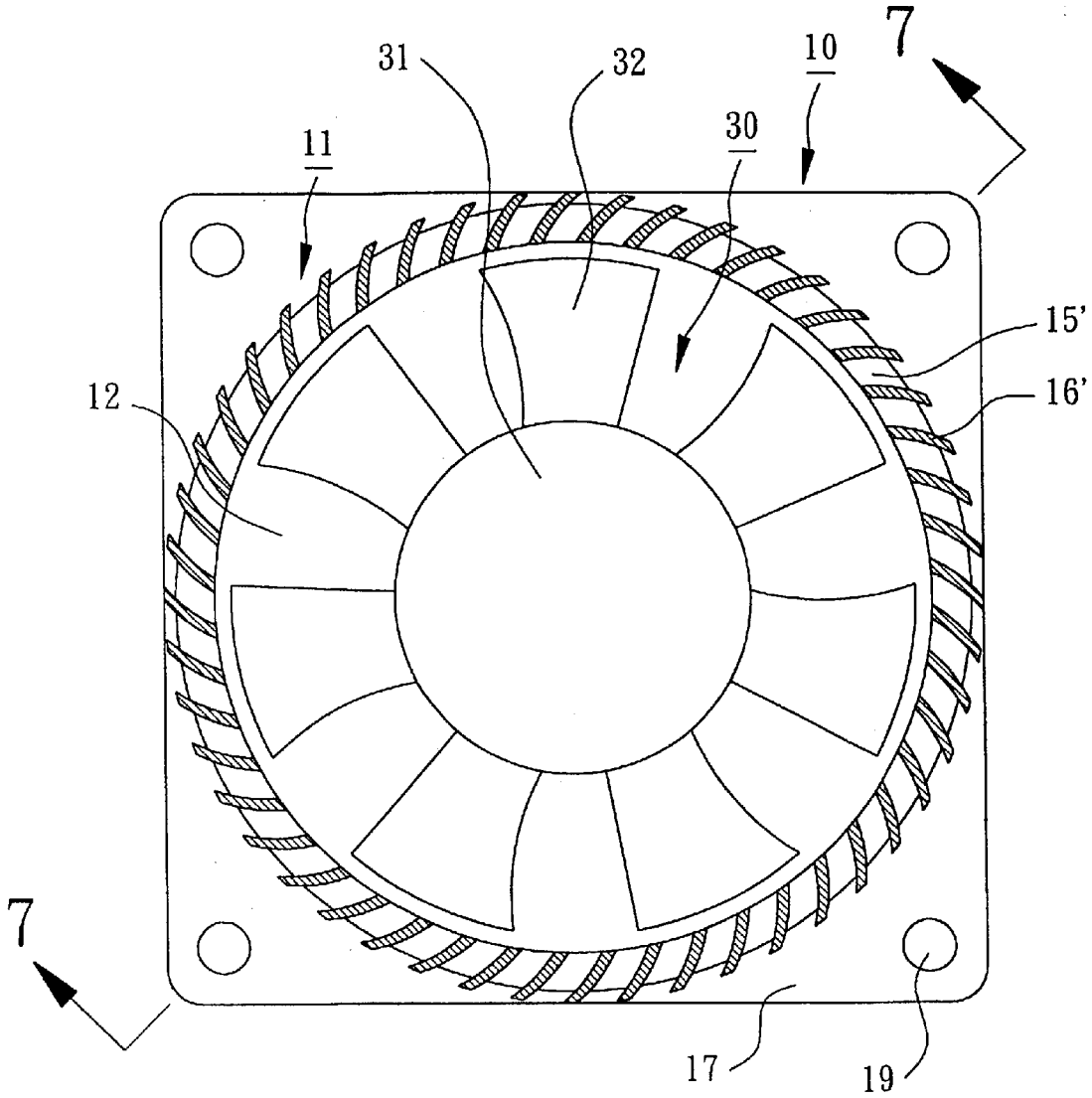
FIG. 6 is a top view of the housing structure for the heat-dissipation fan in accordance with the second embodiment of the present invention.
Figure 7:
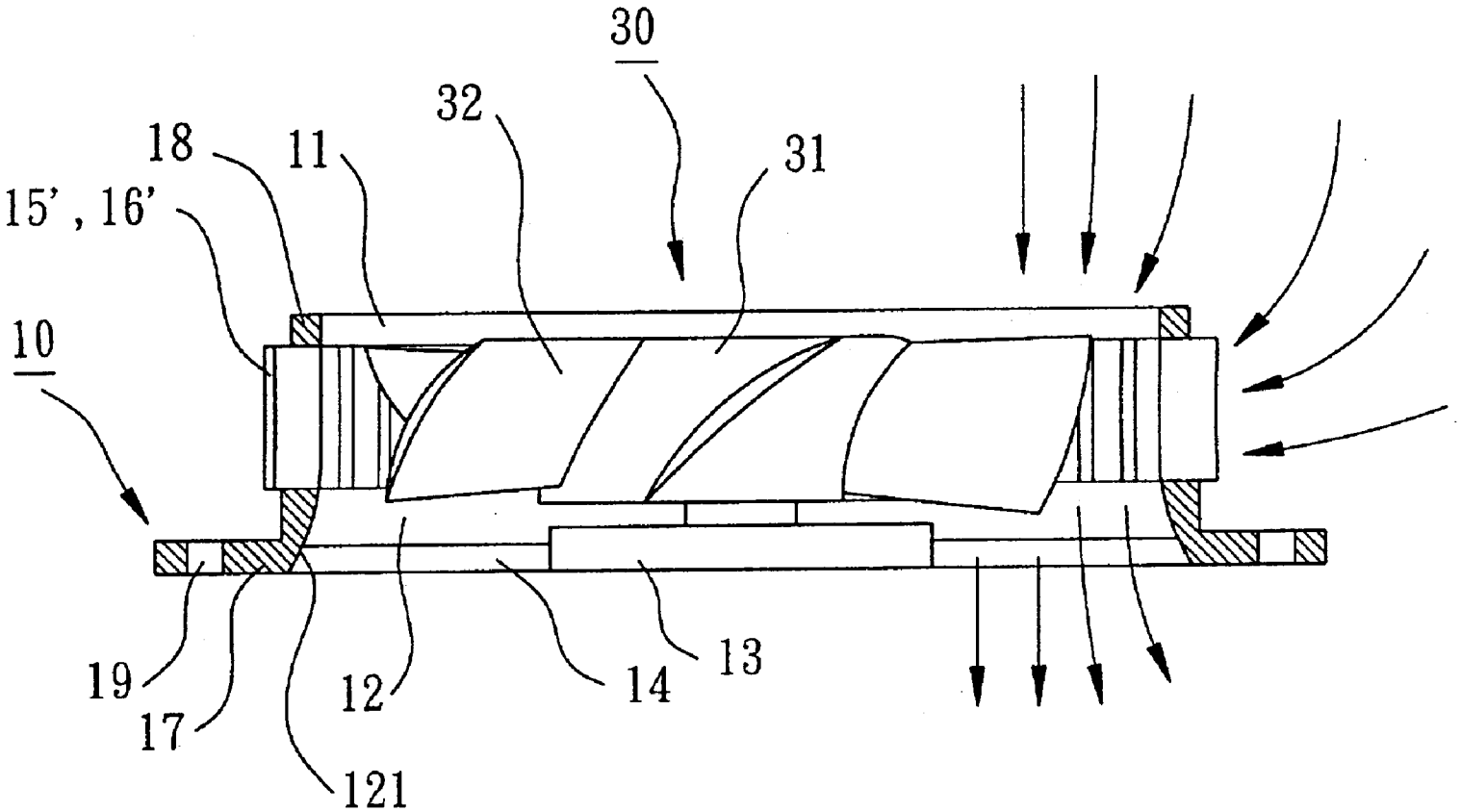
FIG. 7 is a cross-sectional view, taken along line 7—7 in FIG. 6, of the housing structure for the heat-dissipation fan in accordance with the second embodiment of the present invention.

Referring to FIGS. 5 through 7, a housing structure for a heat-dissipation fan in accordance with the second embodiment of the present invention includes an air inlet 11, an air outlet 12, a plurality of axial guide blades 15' and a plurality of radial air inlets 16'. In contrast with the first embodiment, the axial guide blades 15' of the second embodiment are slanted and thereby the radial air inlets 16' are aligned with a rotational direction of the blades 32 of the rotor 30 so as to increase air inlet amount and reduce air noise. Moreover, the air outlet 12 is expanded and shaped as a bell so as to increase measurements. Preferably, the housing 10 further includes a circumferential wall 171 to define the expanded air outlet 12 to thereby intensify the entire structure.

Figure 8:
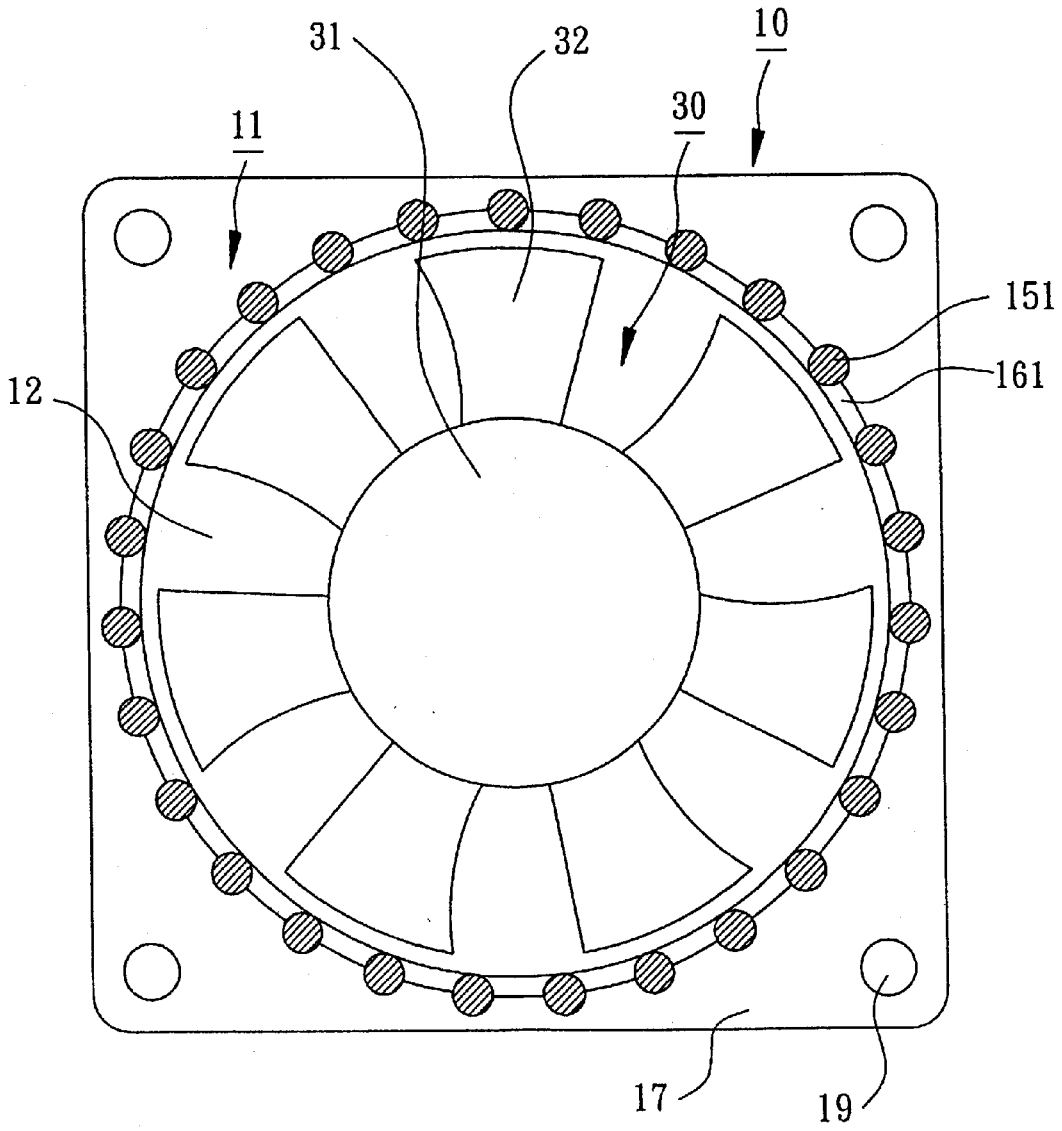
FIG. 8 is a top view of a housing structure for a heat-dissipation fan in accordance with a third embodiment of the present invention.

Referring to FIG. 8, a housing structure for a heat-dissipation fan in accordance with the third embodiment of the present invention includes a plurality of axial guide blade 151 and a plurality of radial air inlets 161. In contrast with the first embodiment, each of the axial guide blades 151 of the third embodiment is formed as a post and has a circular cross section. Consequently, circular surfaces of the guide blades 151 may increase airflow passed through the air inlets 161.

Figure 9:
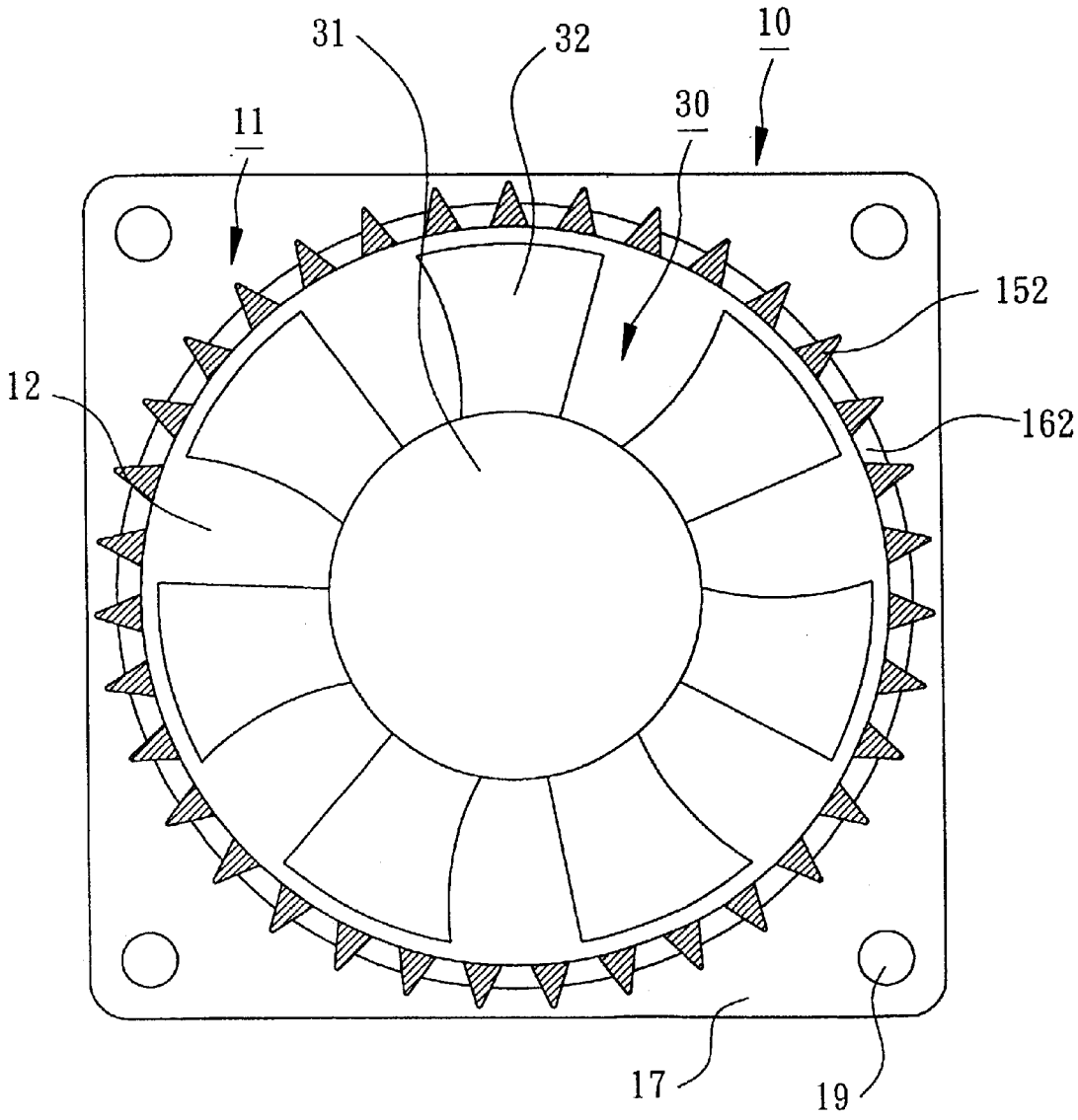
FIG. 9 is a top view of a housing structure for a heat-dissipation fan in accordance with fourth embodiment of the present invention.

Referring to FIG. 9, a housing structure for a heat-dissipation fan in accordance with the fourth embodiment of the present invention includes a plurality of axial guide blade 152 and a plurality of radial air inlets 162. In contrast with the first embodiment, each of the axial guide blades 152 of the fourth embodiment is formed as a prism and has a triangular cross section. Consequently, inclined surfaces of the guide blades 152 may increase airflow passed through the air inlets 162.

Referring again to FIGS. 2 and 1, the housing 10 of the present invention includes axial guide blades 15 to form radial air inlets 16 therebetween that air inflow is increased and air noise is reduced. However, the housing design of the conventional axial-flow type fan is limited in measurements and causes air turbulence and wind shear. By contrast, P-Q characteristic and efficiency of the present invention is improved.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A housing structure comprising:

a housing having an air inlet and an air outlet between which receiving a stator and a rotor;

a plurality of axial guide blades equi-spaced and radially extended outward from the housing proximate the air inlet; and a plurality of radial air inlets spaced by the axial guide blades;

wherein when the rotor is rotated, airflow sucked through the radial air inlets is guided parallel to an axis of the housing running from the air inlet to the air outlet so as to increase air inlet amount and reduce air noise.

2. The housing structure as defined in claim 1, wherein the axial guide blades are slanted and thereby the radial air inlets are aligned with a rotational direction of the rotor so as to increase air inlet amount and reduce air noise.

3. The housing structure as defined in claim 1, wherein the axial guide blade is formed as a flat piece, a post or a prism.

4. The housing structure as defined in claim 1, wherein the housing further includes a base plate arranged therearound proximate the air outlet; the axial guide blades are equi-spaced and connected to a side of the base plate proximate the air inlet.

5. The housing structure as defined in claim 1, wherein the housing further includes an annular support integrally connected to top portions of the axial guide blades.

6. The housing structure as defined in claim 1, wherein the air outlet is expanded and shaped as a bell so as to increase measurements.

7. The housing structure as defined in claim 1, wherein the housing further includes a circumferential wall to define the air outlet to thereby intensify the entire structure.

8. The housing structure as defined in claim 1, wherein the housing is made of metal to thereby increase heat-dissipation efficiency.

9. The housing structure as defined in claim 1, wherein the axial guide blades and the radial air inlets are punched when the housing is made of metal or alloy.

10. The housing structure as defined in claim 4, wherein the base plate of the housing further includes a plurality of assembling holes for conveniently assembling.

* * * * *